United States Patent [19]

Baird et al.

[11] Patent Number: 4,973,019

[45] Date of Patent: Nov. 27, 1990

[54] CURLING IRON SAFETY HOLDER APPARATUS

[76] Inventors: Barbara D. Baird; Wayne P. Mullin, both of 60 Moyer Road, Welland Ontario, Canada

[21] Appl. No.: 415,556

[22] Filed: Oct. 2, 1989

[51] Int. Cl.[5] ..... A47F 5/00

[52] U.S. Cl. ..... 248/314; D28/38; 248/117.1

[58] Field of Search ..... 248/314, 315, 311.2, 248/309.1, 117.1, 117.2, 117.3, 117.5, 117.6, 117.7; 132/232; D28/38; D6/573; 211/70.6

[56] References Cited

U.S. PATENT DOCUMENTS

| | | | |
|---|---|---|---|
| D. 243,559 | 3/1977 | Hoyle et al. | D28/38 |
| D. 293,651 | 1/1988 | Aeschliman | 248/314 X |
| 2,235,986 | 3/1941 | Ellingson | 248/315 |
| 3,273,846 | 9/1966 | Mare | 248/314 X |
| 4,065,084 | 12/1977 | Wiener | 248/302 X |
| 4,159,773 | 7/1979 | Losenno | 248/117.1 X |
| 4,251,043 | 2/1981 | Horner | 248/117.6 |

*Primary Examiner*—Ramon O. Ramirez
*Attorney, Agent, or Firm*—Leon Gilden

[57] ABSTRACT

A curling iron apparatus is presented for safely securing and containing a curling iron therewithin. The apparatus includes an inner and outer cylinder, each of an equal predetermined axial length coaxially arranged relative to one another to provide an insulative barrier to maintain a curling iron therewithin. An embodiment of the instant invention includes a plurality of such holders spaced on a bracket structure to receive a curling iron and an associate electrical curling brush or the like in a spaced relationship relative to one another. A further embodiment of the instant invention utilizes a plurality of spaced rings mounted on a "U" shaped bracket, wherein the bracket includes wire pins for maintaining an associated cord of the iron in a convenient relationship relative to the curling iron.

5 Claims, 6 Drawing Sheets

PRIOR ART

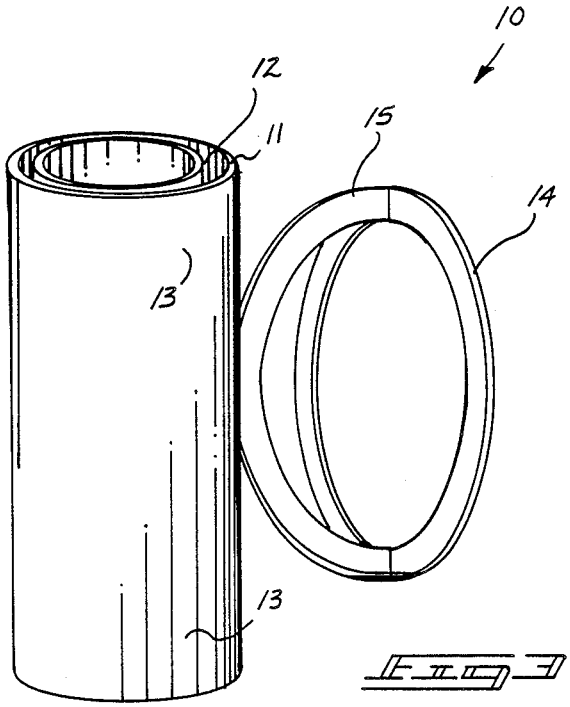
FIG. 3
FIG. 4
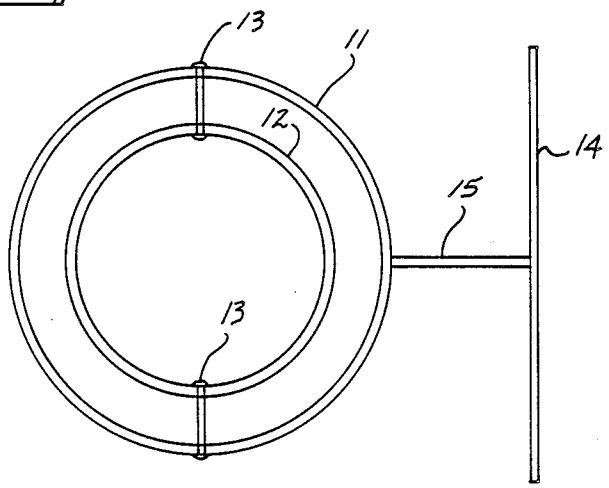

CURLING IRON SAFETY HOLDER APPARATUS

BACKGROUND OF THE INVENTION

1. Field of the Invention

The field of invention relates to curling iron support structures, and more particularly pertains to a new and improved curling iron safety holder apparatus wherein the same safely and securely positions a curling iron for subsequent use avoiding inadvertent injury to an individual.

2. Description of the Prior Art

The use of various curling irons and holders is well known in the prior art. Heretofore, however, the prior art organizations have failed to provide necessary safe&y in securing and maintaining a curling iron in a fixed relationship relative to a support structure to prevent inadvertent injury upon an individual engaging a surface of the heated iron. Examples of the prior art include U.S. Pat. No. 3,892,943 to Droogenbroek wherein a curling iron support and recharging stand positions a curling iron in a vertical orientation relative to the stand, but as is typical of the prior art, exposes the curling iron to inadvertent engagement with an individual as it is unprotected about its surface during a heating operation.

U.S. Pat. No. 4,308,878 to Silva sets forth a curling iron holder formed of a molded plastic for surrounding relationship relative to a forward end of the curling iron, wherein the structure, while forming a muzzle-like arrangement about the curling iron, provides an inconvenient support, as opposed to the instant invention that is structurally supported by a wall and the like to enable the convenient insertion and removal of the curling iron relative to the support.

U.S. Pat. No. 4,159,773 to Losenno utilizes a bracket arrangement formed with spring clips to frictionally engage and support a plurality of curling irons thereon, but with typical exposure of the irons to inadvertent injury by an individual.

U.S. Pat. No. 4,065,084 to Wiener provides a soldering iron support stand utilizing a coiled support bracket formed of a wire-like material to slidably receive a soldering iron therewithin.

U.S. design Pat. No. 29,230 to Pflieger utilizes a wire mounted rack formed with a single loop for receiving a curling iron therethrough with the typical unprotected surface of the curling iron exposed for inadvertent injury.

As such it may be appreciated that there is a continuing need for a new and improved curling iron safety holder apparatus wherein the same addresses both the problems of ease of use and effectiveness in organization and in this respect, the present invention substantially fulfills this need.

SUMMARY OF THE INVENTION

In view of the foregoing disadvantages inherent in the known types of curling iron support arrangements now present in the prior art, the present invention provides a curling iron safety holder apparatus wherein the same provides for a shielded support arrangement in relationship to an enclosed curling iron. As such, the general purpose of the present invention, which will be described subsequently in greater detail, is to provide a new and improved curling iron safety holder apparatus which has all the advantages of the prior art curling iron holder arrangements and none of the disadvantages.

To attain this the curling iron safety holder apparatus includes an inner cylinder arranged coaxially relative to an outer cylinder to provide a heat shield to maintain an enclosed curling iron in a safety arrangement relative to an individual including a support bracket formed with a spacer portion, such as a semi-cylindrical further bracket, to space the holder arrangement relative to a support surface, such as a wall. A further embodiment of the instant invention includes upper and lower coaxially spaced rings to receive a curling iron therethrough formed with support legs diametrically aligned with each of the rings, wherein each of the legs includes pins for maintaining an associated electrical cord in a secure manner relative to a curling iron. A further embodiment of the instant invention includes a plurality of spaced holders to receive a plurality of heated instruments, such as a curling iron and heated hair brushing arrangement in a spaced relationship relative to one another. A further holder arrangement includes a series of coaxially arranged downwardly extending grooves positioned interiorly of the inner cylinder to maintain heat within the cylinder to enhance a heating of an inserted curling iron therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved curling iron safety holder apparatus which has all the advantages of the prior art curling iron holder arrangements and none of the disadvantages.

It is another object of the present invention to provide a new and improved curling iron safety holder apparatus which may be easily and efficiently manufactured and marketed.

It is a further object of the present invention to provide a new and improved curling iron safety holder apparatus which is of a durable and reliable construction.

An even further object of the present invention is to provide a new and improved curling iron safety holder apparatus which is susceptible of a low cost of manufacture with regard to both materials and labor, and which accordingly is then susceptible of low prices of sale to the consuming public, thereby making such curling iron safety holder apparatus economically available to the buying public.

Still yet another object of the present invention is to provide a new and improved curling iron safety holder apparatus which provides in the apparatuses and methods of the prior art some of the advantages thereof, while simultaneously overcoming some of the disadvantages normally associated therewith.

Still another object of the present invention is to provide a new and improved curling iron safety holder apparatus wherein the same utilizes a shielding arrangement to prevent inadvertent injury to an individual from accidental contact with an associated curling iron.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 an isometric illustration of the instant invention.

FIG. 4 is a top orthographic view of the instant invention.

DESCRIPTION OF THE PREFERRED EMBODIMENT

Figure 1:
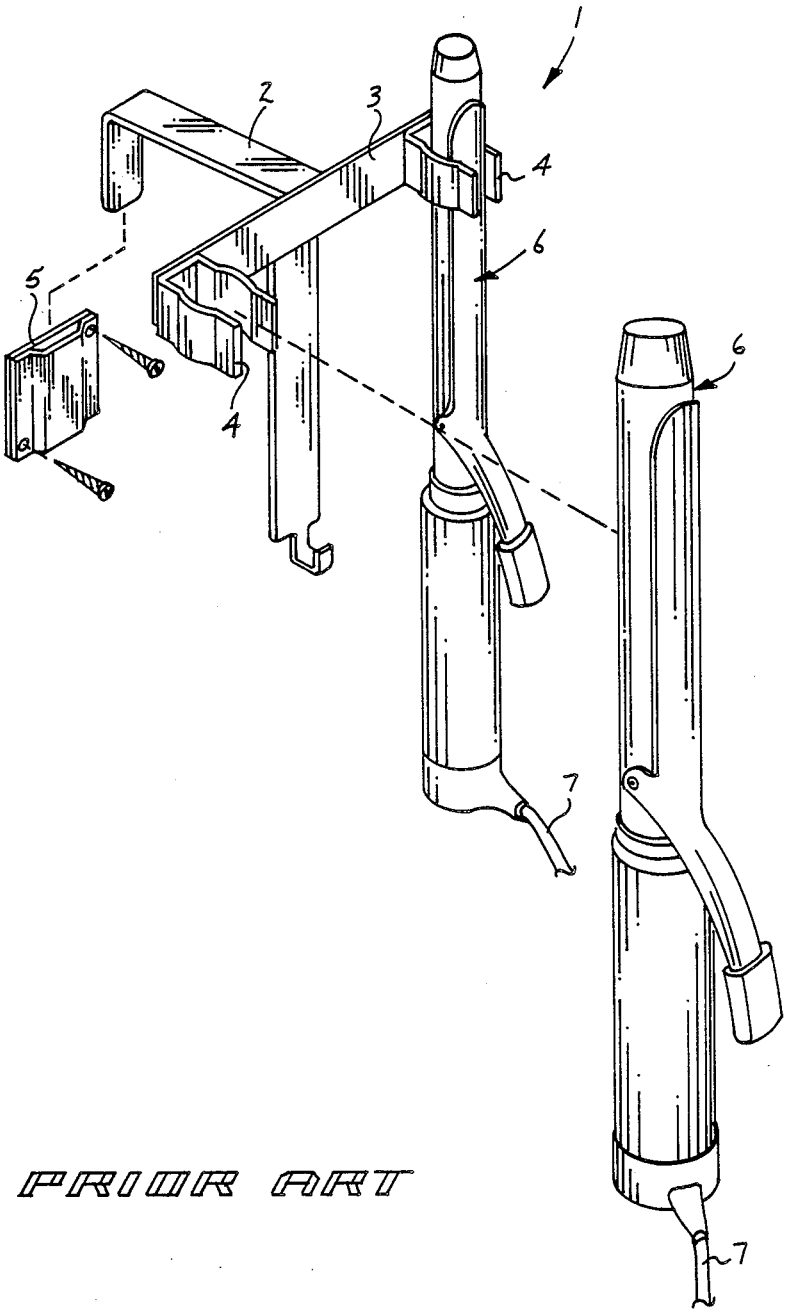
FIG. 1 is an isometric illustration of a prior curling iron holder apparatus.

With reference now to the drawings, and in particular to FIGS. 1 to 9 thereof, a new and improved curling iron safety holder apparatus embodying the principles and concepts of the present invention and generally designated by the reference numerals 10, 10*a*, and 10*b* will be described.

More specifically, the curling safety holder apparatus 10 provides an improved safety arrangement relative to a prior art support rack 1, as illustrated in FIG. 1, that typically includes a "U" shaped bracket 2 formed with a cross bracket 3. The cross bracket 3 has mounted thereon a plurality of spring clips 4 for receiving a curling iron 6, or a plurality of such curling irons, in a spaced relationship relative to one another, but enabling exposure of the heating element of the curling iron. The associated electrical cord 7 of the curling iron 6 is permitted to dangle relative to the prior art arrangement. The "U" shaped bracket 2 is receivable within a support sleeve 5 that is typically mounted upon a wall surface.

Figure 2:
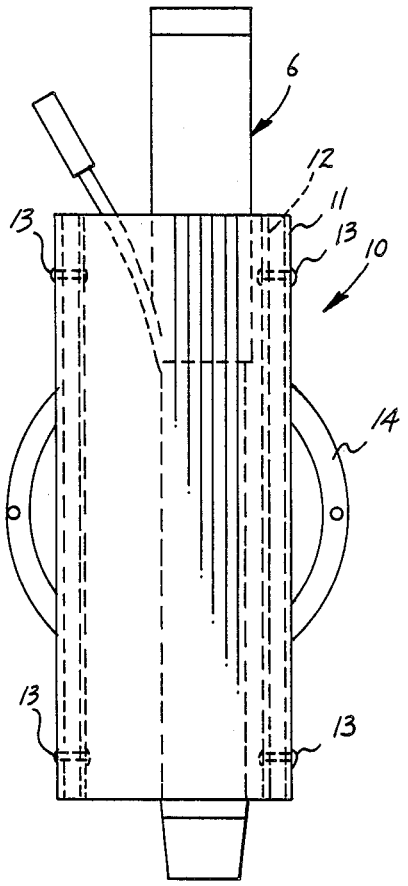
FIG. 2 is an orthographic frontal view taken in elevation of the instant invention.

FIG. 2 is illustrative of a curling iron apparatus 10 formed with an outer cylinder 11 defined by an axial length less than that of an associated curling iron 6 with an inner cylinder 12 coaxially aligned and spaced interiorly of the outer cylinder 11 of an equal axial length including diametrically spaced pairs of clips 13 to maintain the desired spacing of the inner and outer cylinders 12 and 11 relative to one another. A support bracket 14 defined as a cylindrical support ring includes a semi-cylindrical spacer ring 15 orthogonally arranged relative to the support bracket 14 to space the cylinders 11 and 12 from an associated wall surface, as illustrated in FIGS. 3 and 4 for example.

Figure 5:
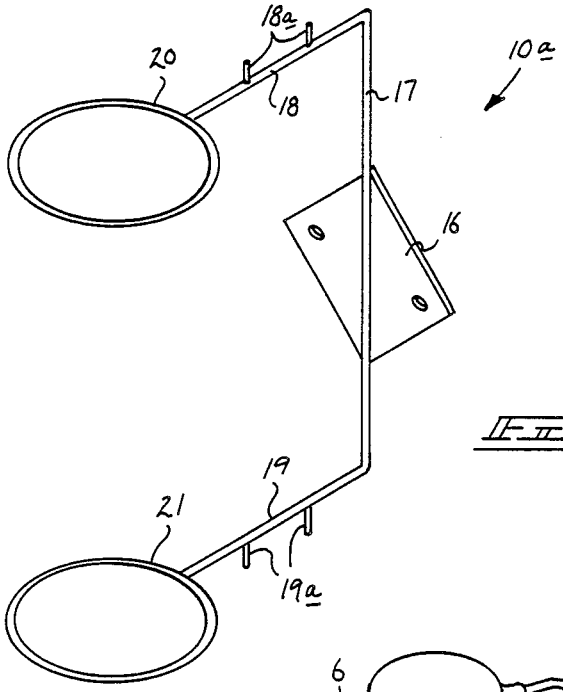
FIG. 5 is an isometric illustration of a further embodiment of the instant invention.
Figure 6:
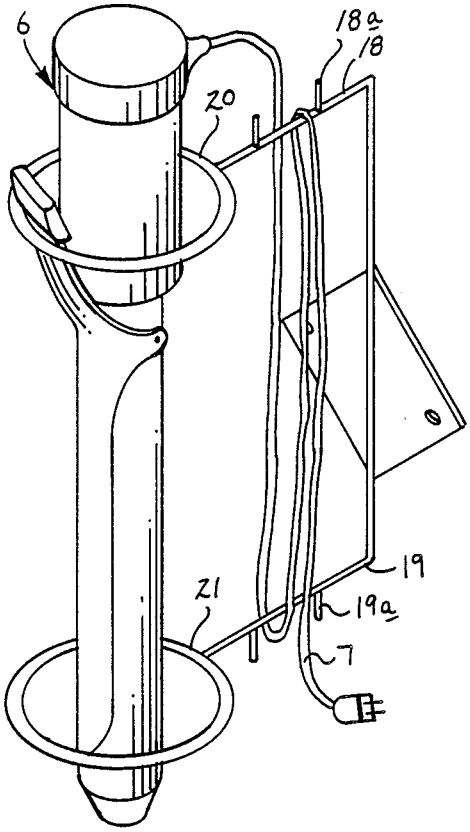
FIG. 6 is an isometric illustration of the invention as depicted in FIG. 5 with an included curling iron positioned therewithin.

FIGS. 5 and 6 illustrate a further embodiment 10*a* of the apparatus including an apertured support plate 16 formed with a "U" shaped bracket 17 mounted integrally and orthogonally relative to the support plate 16, wherein the bracket 17 includes an upper and lower leg 18 and 19 respectively overlying one another in a parallel relationship, wherein the upper leg 18 includes a plurality of upper support pins 18*a* directed orthogonally upwardly of the upper leg 18 with lower support pins 19*a* directed orthogonally downwardly from the lower support leg 19. An upper horizontal ring 20 is arranged in a parallel relationship relative to a lower ring 21, wherein the upper and lower rings are diametrically secured and arranged relative to free terminal ends of the upper and lower legs 18 and 19. FIG. 6 illustrates the associated curling iron 6 coaxially arranged within the rings 20 and 21 with the associated curling iron's electrical cord 17 wrapped between the plural pairs of upper and lower support pins 18 and 19*a* to securely contain the cord in a convenient relationship relative to the curling iron 6.

Figure 7:
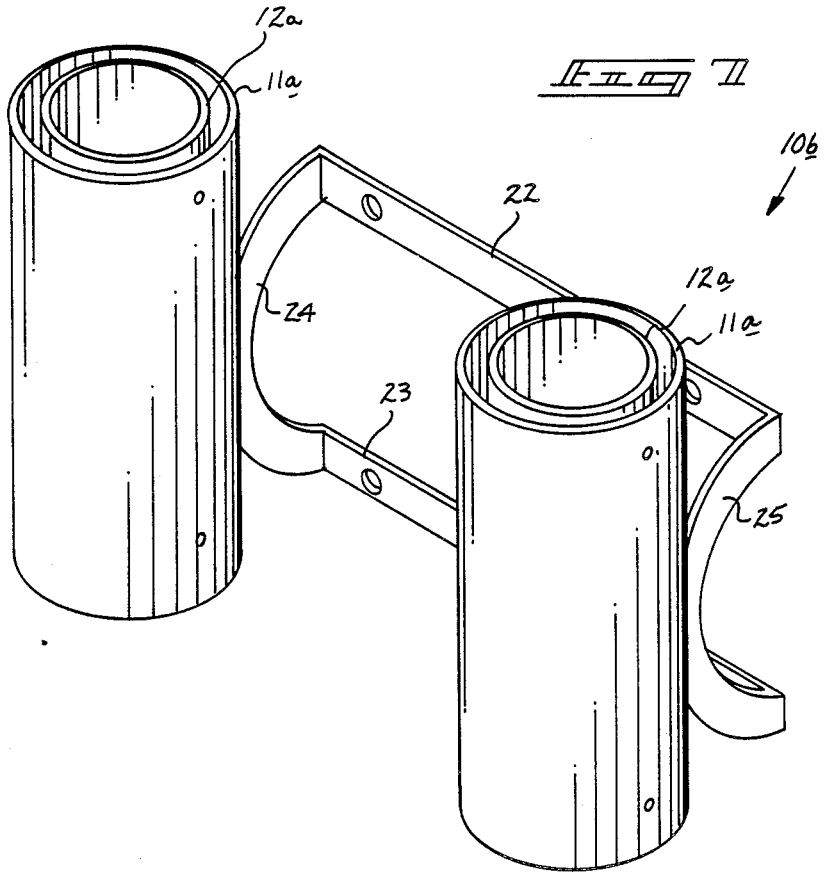
FIG. 7 is an isometric illustration of a third embodiment of the instant invention.
Figure 8:
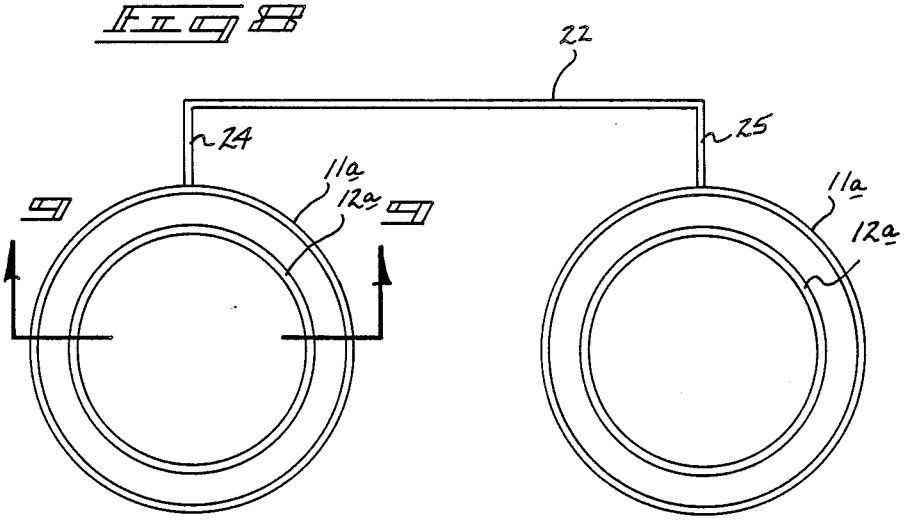
FIG. 8 is a top orthographic view of the third embodiment as set forth in FIG. 7.

FIGS. 7 and 8 are illustrative of a third embodiment 10*b* providing a plurality of support cylinders for use with a plurality of curling irons, or more specifically a single curling iron and a heated hair-type brush, as is found in the styling arts. The embodiment set forth in FIGS. 7 and 8 includes an upper support plate 22 overlying and aligned with a lower support plate 23 with respective left and right semi-cylindrical spacer rings 24 and 25 securing the respective right and left terminal ends of the upper and lower support plates. The support rings 24 and 25 have secured tangentially thereto the respective support cylinders, including an outer support cylinder 11*a* and an inner support cylinder 12*a* coaxially aligned relative to one another.

Figure 9:
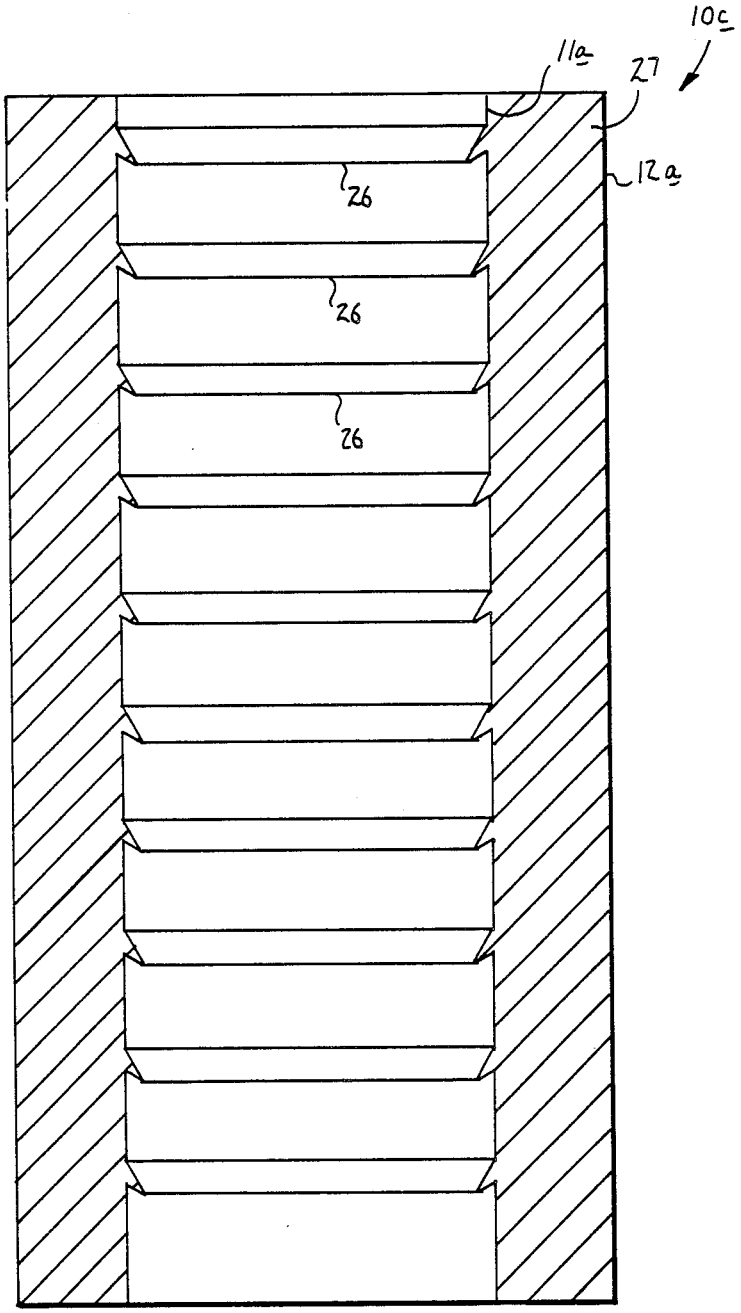
FIG. 9 is a cross-sectional view of a modified curling iron support cylinder contemplated by the instant invention.

FIG. 9 illustrates the use of a modified support cylinder 10*c* that includes an outer ring 12*a* and an inner ring 11*a* coaxially aligned relative to one another and of equal length formed with an insulative material 27 therebetween and including a series of coaxially aligned and downwardly depending circular flanges 26. The flanges in cooperation with the insulative material 27 assist in maintaining heat interiorly of the inner support cylinder 11*a* to assist in the heating of an associated curling iron 6 to be inserted therewithin.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A curling iron support apparatus for use with a curling iron defined by an elongate body of a fixed length and an elongate flexible electrical cord extending from the body, the apparatus comprising, a curling iron mounting means for receiving a curling iron therein, the mounting means including a bracket member securable to vertical support surface wherein the bracket member includes a further bracket member to space the mounting means from the bracket member, and wherein the mounting means includes a first cylinder of a predetermined length and a second cylinder defined by a length equal to the predetermined length coaxially mounted interiorly and coextensivley relative to the first cylinder to define a gap between the first and second cylinder, and further including plural pairs of diametrically aligned clip members to space the first cylinder relative to the second cylinder.

2. A curling iron support apparatus as set forth in claim 1 wherein the bracket member is defined by a cylindrical ring and the further bracket member is defined by a semi-cylindrical ring orthogonally mounted relative to the bracket member wherein the first cylinder is tangentially and fixedly mounted relative to the further bracket member.

3. A curling iron support apparatus as set forth in claim 1 wherein the bracket member is defined by an upper elongate support plate coextensively aligned overlying a lower support plate, and a first semi-cylindrical ring and a second cylindrical ring are integrally secured to opposed respective ends of the upper and lower support plates, wherein the first cylinder is mounted to the first semi-cylindrical ring and includes a further first cylinder mounted to the second cylindrical ring, wherein each of the first cylinders includes the second cylinder coaxially mounted therewithin.

4. A curling iron support apparatus as set forth in claim 3 wherein the gap defined between the first and second cylinders includes a thermally insulative material positioned therebetween, and the second cylinder includes a series of equally spaced downwardly extending flanges fixedly mounted throughout an interior surface defined by the second cylinder to maintain heat within the second cylinder when the curling is positioned therewithin.

5. A curling iron support apparatus as set forth in claim 1 wherein the bracket member is defined by an apertured support plate, and the further bracket member is defined by a "U" shaped bracket formed with an upper leg parallel to a lower leg, the upper leg includes a plurality of upper pins projecting orthogonally upwardly therefrom, and the lower leg includes a plurality of lower pins projecting downwardly therefrom, and the upper leg includes a first ring diametrically aligned with the upper leg and fixedly mounted to a free end thereof overlying a lower ring diametrically aligned with and fixedly mounted to a free end of the lower leg, wherein the upper and lower rings are coaxially aligned relative to one another to receive a curling iron therewith, and wherein the respective upper and lower pins are spaced for receiving the electrical cord therebetween to maintain the cord in a secure arrangement relative to the curling iron.

* * * * *